US010739700B2

(12) United States Patent
Sakamoto

(10) Patent No.: US 10,739,700 B2
(45) Date of Patent: Aug. 11, 2020

(54) IMAGE FORMING APPARATUS

(71) Applicant: KYOCERA Document Solutions Inc., Osaka (JP)

(72) Inventor: Yasuaki Sakamoto, Osaka (JP)

(73) Assignee: Kyocera Document Solutions, Inc. (JP)

( * ) Notice: Subject to any disclaimer, the term of this patent is extended or adjusted under 35 U.S.C. 154(b) by 0 days.

(21) Appl. No.: 16/011,145

(22) Filed: Jun. 18, 2018

(65) Prior Publication Data

US 2019/0018342 A1 Jan. 17, 2019

(30) Foreign Application Priority Data

Jul. 12, 2017 (JP) ..... 2017-135908
Jul. 12, 2017 (JP) ..... 2017-135909
Jul. 12, 2017 (JP) ..... 2017-135910
Jul. 12, 2017 (JP) ..... 2017-135911

(51) Int. Cl.
*G03G 15/08* (2006.01)
*G03G 15/16* (2006.01)
*G03G 15/00* (2006.01)

(52) U.S. Cl.
CPC ..... *G03G 15/0865* (2013.01); *G03G 15/0808* (2013.01); *G03G 15/161* (2013.01); *G03G 15/168* (2013.01); *G03G 15/5058* (2013.01); *G03G 15/55* (2013.01); *G03G 2215/1661* (2013.01)

(58) Field of Classification Search
USPC ..... 399/258
See application file for complete search history.

(56) References Cited

U.S. PATENT DOCUMENTS

2010/0231934 A1* 9/2010 Takagaki ..... G03G 15/0131 358/1.9
2010/0238465 A1* 9/2010 Kageyama ..... G03G 15/0131 358/1.9
2010/0290800 A1* 11/2010 Akiyama ..... G03G 15/0131 399/66
2015/0042738 A1* 2/2015 Miyadera ..... G03G 15/043 347/118
2016/0274521 A1* 9/2016 Iwata ..... G03G 15/5041

FOREIGN PATENT DOCUMENTS

JP 2000-356935 12/2000
JP 2006-194963 7/2006
JP 2007-004079 1/2007
JP 2010-266536 11/2010

* cited by examiner

*Primary Examiner* — Quana Grainger

(57) ABSTRACT

An image forming apparatus includes an intermediate transfer belt, a density sensor, a cleaning device and a density correction unit. The intermediate transfer belt carries a calibration toner image. The density sensor detects a density of the calibration toner image that passes at a predetermined position. The cleaning device contacts to a part of the intermediate transfer belt in a primary scanning direction, and removes from the intermediate transfer belt the calibration toner image that passed at the predetermined position. The density correction unit performs density correction of a printing toner image in the primary scanning direction. Further, the density correction unit changes a strength of the density correction for a contact range to which the cleaning device contacts on the intermediate transfer belt, the strength changed in accordance with the number of times of a calibration process.

15 Claims, 15 Drawing Sheets

PRIOR ART

PRIOR ART

PRIOR ART

IMAGE FORMING APPARATUS

CROSS-REFERENCE TO RELATED APPLICATIONS

This application relates to and claims priority rights from (1) Japanese Patent Application No. 2017-135908, filed on Jul. 12, 2017, (2) Japanese Patent Application No. 2017-135909, filed on Jul. 12, 2017, (3) Japanese Patent Application No. 2017-135910, filed on Jul. 12, 2017, and (4) Japanese Patent Application No. 2017-135911, filed on Jul. 12, 2017, the entire disclosures of which are hereby incorporated by reference herein.

BACKGROUND

1. Field of the Present Disclosure

The present disclosure relates to an image forming apparatus.

2. Description of the Related Art

An electrophotographic image forming apparatus forms a toner image for calibration (a so-called toner patch) on an intermediate transfer belt and measures a density of the toner patch using a density sensor, and adjusts a toner density, a toner gradation and/or the like.

An image forming apparatus removes such a toner patch from the intermediate transfer belt using a cleaning roller before a secondary transfer roller. The cleaning roller is configured to contact to a part of the intermediate transfer belt at a passing position of the toner patch in a primary scanning direction.

FIG. 13 shows a diagram that indicates an example of a position where a toner patch is carried on an intermediate transfer belt. FIG. 14 shows a diagram that indicates another example of a position where a toner patch is carried on an intermediate transfer belt. FIG. 15 shows a diagram that indicates another example of a position where a toner patch is carried on an intermediate transfer belt. For example, as shown in FIGS. 13 to 15, a toner patch is arranged to avoid a toner object (i.e. a printing toner image) in a printing image area. In an example shown in FIG. 15, a toner patch is arranged outside the printing image area in a primary scanning direction. In examples shown in FIGS. 13 and 14, a toner patch is formed so as to extend to a rear end part (a part that includes no toner objects) of the printing image area of a page and a front end part (a part that includes no toner objects) of the printing image area of a subsequent page.

In particular, in the example shown in FIG. 14, a toner object and a toner patch are arranged in parallel along a secondary scanning direction and therefore many toner patches can be formed, but as mentioned, the cleaning roller contacts only a part in the primary scanning direction so as not to remove a printing toner image.

However, a surface of the intermediate transfer belt gets ununiform condition variation in the primary scanning direction due to usage because, as mentioned, the cleaning roller to remove the calibration toner image contacts to only a part of the intermediate transfer belt in the primary scanning direction. Consequently, a secondary transfer rate or the like gets ununiform in the primary scanning direction and thereby a low image quality occurs in a printed matter.

SUMMARY

An image forming apparatus according to an aspect of the present disclosure includes an intermediate transfer belt, a density sensor, a cleaning device and a density correction unit. The intermediate transfer belt is configured to carry a calibration toner image. The density sensor is configured to detect a density of the calibration toner image that passes at a predetermined position. The cleaning device is configured to contact to a part of the intermediate transfer belt in a primary scanning direction and remove from the intermediate transfer belt the calibration toner image that passed at the predetermined position. The density correction unit is configured to perform density correction of a printing toner image in the primary scanning direction. Further, the density correction unit changes a strength of the density correction for a contact range to which the cleaning device contacts on the intermediate transfer belt, the strength changed in accordance with the number of times of a calibration process.

An image forming apparatus according to an aspect of the present disclosure includes an intermediate transfer belt, a first optical sensor, a calibration processing unit, a cleaning device, a second optical sensor and a density correction unit. The intermediate transfer belt is configured to carry a calibration toner image. The first optical sensor is configured to (a) irradiate with light a predetermined first position at which the calibration toner image passes and (b) receive reflection light from the first position. The calibration processing unit is configured to perform a calibration process based on an output signal of the first optical sensor, the output signal corresponding to the calibration toner image. The cleaning device is configured to (a) contact to a part of the intermediate transfer belt in a primary scanning direction and (b) remove from the intermediate transfer belt the calibration toner image that passed at the first position. The second optical sensor is configured to (a) irradiate with light a predetermined second position and (b) receive reflection light from the second position, the second position being a position other than a contact range to which the cleaning device contacts on the intermediate transfer belt. The density correction unit is configured to perform density correction of a printing toner image in the primary scanning direction. Further, the density correction unit changes a strength of the density correction in the contact range on the basis of (a) an output signal of the first optical sensor and (b) an output signal of the second optical sensor, the output signal of the first optical sensor corresponding to a surface material of the intermediate transfer belt at the first position, and the output signal of the second optical sensor corresponding to a surface material of the intermediate transfer belt at the second position.

An image forming apparatus according to an aspect of the present disclosure includes an intermediate transfer belt, a density sensor, a first cleaning device and a second cleaning device. The intermediate transfer belt is configured to carry a calibration toner image. The density sensor is configured to detect a density of the calibration toner image that passes at a predetermined position. The first cleaning device is configured to (a) contact to a predetermined range of the intermediate transfer belt in a primary scanning direction in a calibration process and (b) remove from the intermediate transfer belt the calibration toner image that passed at the predetermined position. The second cleaning device is configured to contact to a residual range other than the predetermined range of the intermediate transfer belt in a primary scanning direction in the calibration process.

An image forming apparatus according to an aspect of the present disclosure includes an intermediate transfer belt, a density sensor, a cleaning device and a calibration processing unit. The intermediate transfer belt is configured to carry a calibration toner image. The density sensor is configured to detect a density of the calibration toner image that passes at a predetermined position. The cleaning device is configured to (a) contact to a part of the intermediate transfer belt in a primary scanning direction in a calibration process and (b) remove from the intermediate transfer belt the calibration toner image that passed at the predetermined position. The calibration processing unit is configured to (a) change a position in a primary scanning direction at which the calibration toner image is carried, and (b) move the density sensor and the cleaning device in the primary scanning direction in accordance with the change of the position of the calibration toner image.

These and other objects, features and advantages of the present disclosure will become more apparent upon reading of the following detailed description along with the accompanied drawings.

DETAILED DESCRIPTION

Embodiment 1

Figure 1:
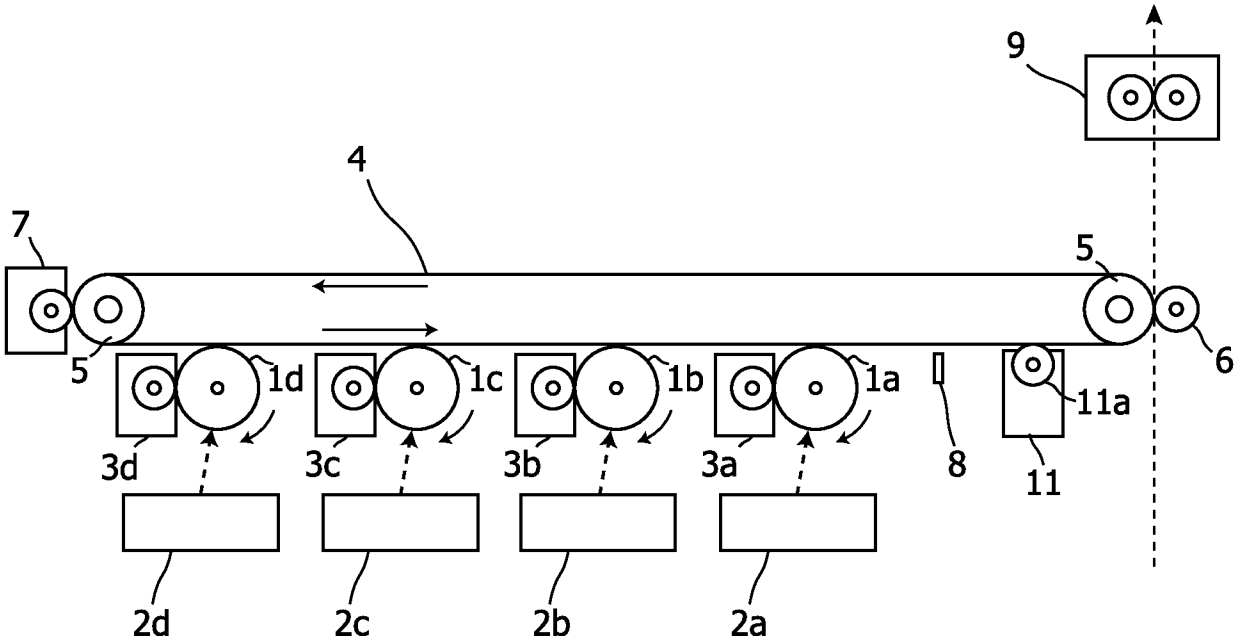
FIG. 1 shows a side view that indicates an internal mechanical configuration of an image forming apparatus in an embodiment according to the present disclosure.

FIG. 1 shows a side view that indicates an internal mechanical configuration of an image forming apparatus in an embodiment according to the present disclosure. The image forming apparatus shown in FIG. 1 is an apparatus including an electrophotographic printing function, such as a printer, a facsimile machine, a copier, or a multi function peripheral.

The image forming apparatus in this embodiment includes a tandem-type color development device. This color development device includes photoconductor drums 1*a* to 1*d*, exposure devices 2*a* to 2*d*, and development devices 3*a* to 3*d* for respective colors. The photoconductor drums 1*a* to 1*d* are photoconductors of four colors: Cyan, Magenta, Yellow and Black. The exposure devices 2*a* to 2*d* are devices that irradiate the photoconductor drums 1*a* to 1*d* with laser light and thereby forms electrostatic latent images. Each of the exposure devices 2*a* to 2*d* includes a laser diode as a light source of the laser light, optical elements (such as lens, mirror and polygon mirror) that guide the laser light to the photoconductor drum 1*a*, 1*b*, 1*c*, or 1*d*, and irradiates the photoconductor drum 1*a*, 1*b*, 1*c*, or 1*d* with the laser light and thereby forms an electrostatic latent image on the photoconductor drum 1*a*, 1*b*, 1*c*, or 1*d*.

Toner containers are attached to the development devices 3*a* to 3*d*, and the toner containers are filled up with toner of four colors: Cyan, Magenta, Yellow and Black, respectively. Development biases are applied to the development devices 3*a* to 3*d*, respectively, and thereby on the basis of a difference between potentials of the development devices 3*a* to 3*d* and the photoconductor drums 1*a* to 1*d*, the development devices 3*a* to 3*d* cause the toner supplied from the toner containers to adhere to electrostatic latent images on the photoconductor drums 1*a* to 1*d*, respectively, and consequently form toner images of the four colors. In this embodiment, if two-component developer is used, toner is agitated with carrier in the development device 3*a*, 3*b*, 3*c*, or 3*d*.

The photoconductor drum 1*a*, the exposure device 2*a* and the development device 3*a* perform development of Magenta. The photoconductor drum 1*b*, the exposure device 2*b* and the development device 3*b* perform development of Cyan. The photoconductor drum 1*c*, the exposure device 2*c* and the development device 3*c* perform development of Yellow. The photoconductor drum 1*d*, the exposure device 2*d* and the development device 3*d* perform development of Black.

The intermediate transfer belt 4 is an image carrier that carries a toner image transferred from the photoconductor drums 1*a* to 1*d*, and is an endless (i.e. loop-shaped) intermediate transfer member. The intermediate transfer belt 4 is hitched around driving rollers 5, and rotates by driving force of the driving rollers 5 towards the direction from the contact position with the photoconductor drum 1*d* to the contact position with the photoconductor drum 1*a*.

When performing a printing process, the intermediate transfer belt 4 carries a printing toner image based on user's desired image data, and when performing a calibration process, the intermediate transfer belt 4 carries a calibration toner image in a predetermined range of a primary scanning direction.

A secondary transfer roller 6 contacts an incoming paper sheet to the intermediate transfer belt 4, and secondarily transfers the toner image on the intermediate transfer belt 4 to the paper sheet. The paper sheet on which the toner image has been transferred is transported to a fuser 9, and consequently, the toner image is fixed on the paper sheet.

A cleaning device 7 includes a cleaning roller, and contacts the cleaning roller to the intermediate transfer belt 4 and thereby removes residual toner on the intermediate transfer belt 4 after the secondary transfer of the toner image to the paper sheet. The cleaning device 7 may use a cleaning blade instead of the cleaning roller.

A density sensor 8 is a reflection-type optical sensor that detects toner on the intermediate transfer belt 4, and irradiates the intermediate transfer belt 4 with light and detects its reflection light in order to measure a toner density of a calibration toner image in a calibration process or the like. In the calibration process, the density sensor 8 irradiates with light a predetermined area where the calibration toner image (i.e. a toner patch set) formed on the intermediate transfer belt 4 passes, detects its reflection light, and outputs an electronic signal corresponding to an intensity of the detected reflection light.

The density sensor 8 is arranged at a passing position of the calibration toner image in the primary scanning direction, and detects a density of the calibration toner image that passes at the passing position.

A cleaning device 11 is arranged between the density sensor 8 and the secondary transfer roller 6, and contacts to a part (a part of a width of a printing image area, that is, a part of an upper limit width of the printing toner image) of the intermediate transfer belt 4 in the primary scanning direction in the calibration process by means of an unshown movement mechanism, and thereby removes the calibration toner image that passed at a detection position of the density sensor 8. Consequently, the calibration toner image is not secondarily transferred. Thus, the calibration toner image is formed within a transferable area of the secondary transfer roller 6, but removed by the cleaning device 11.

The cleaning device 11 includes a contact member 11*a* such as a roller, a blade or a brush, and by means of an unshown movement mechanism, the contact member 11*a* is contacted to the intermediate transfer belt 4. In the primary scanning direction, a length of the contact member 11*a* is (a) equal to or longer than a width of the calibration toner image and (b) shorter than a width of the printing image area (i.e. the upper limit width of the printing toner image). It should be noted that as the calibration toner image, a predetermined number of toner patch sequences are formed along the secondary scanning direction. The number of the contact members 11*a* is equal to the number of the calibration toner images arranged along the primary scanning direction (i.e. the number of the toner patch sequences).

Figure 2:
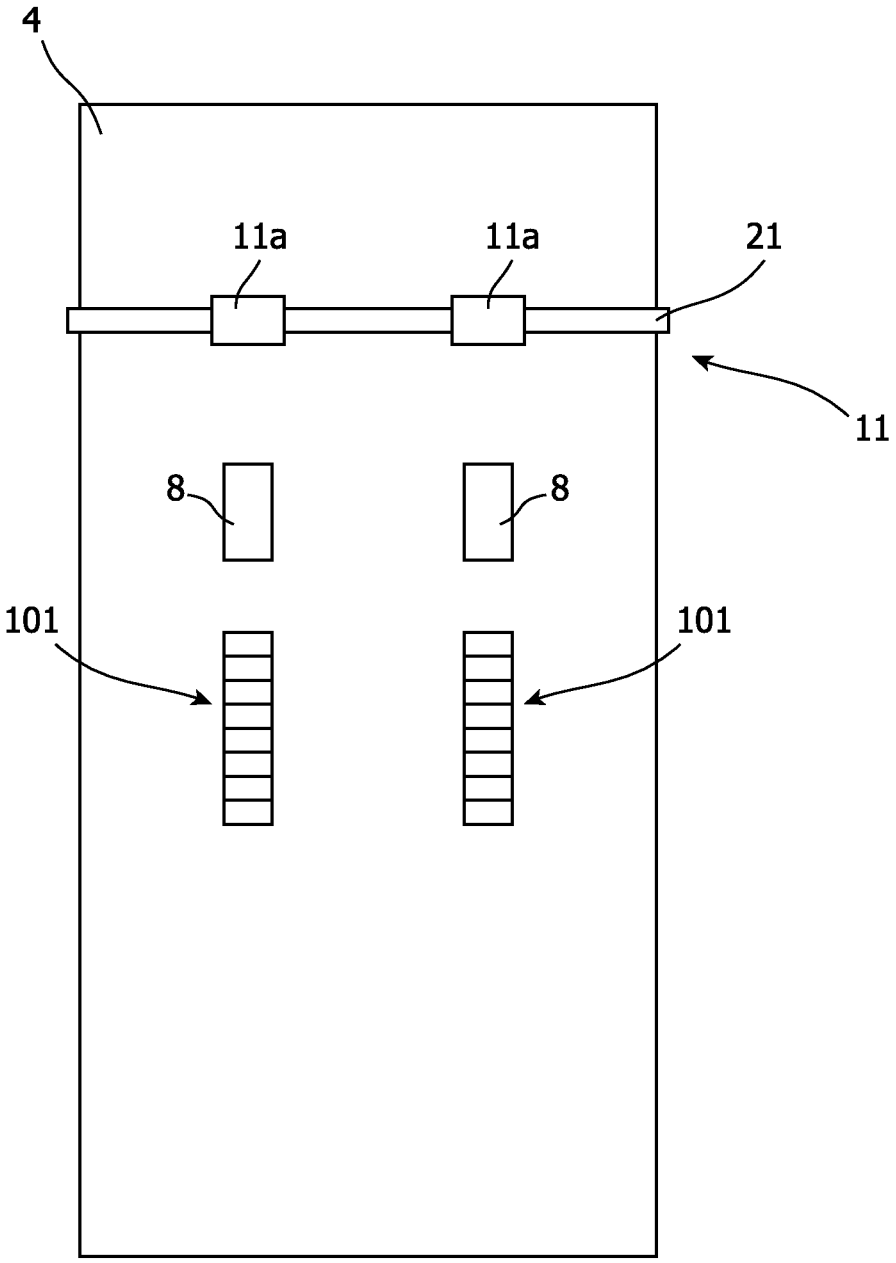
FIG. 2 shows a diagram that indicates an example of a cleaning device 11 in Embodiment 1.

FIG. 2 shows a diagram that indicates an example of the cleaning device 11 shown in FIG. 1. The cleaning device 11 shown in FIG. 2 includes a cleaning roller 21, and the cleaning roller 21 includes two cylindrical contact members 11*a*. The calibration toner images 101 that passed at a detection position of the density sensor 8 are removed by the contact members 11*a*. Toner removed by the contact members 11*a* is collected and disposed from the contact members 11*a* by an unshown collection mechanism.

Figure 3:
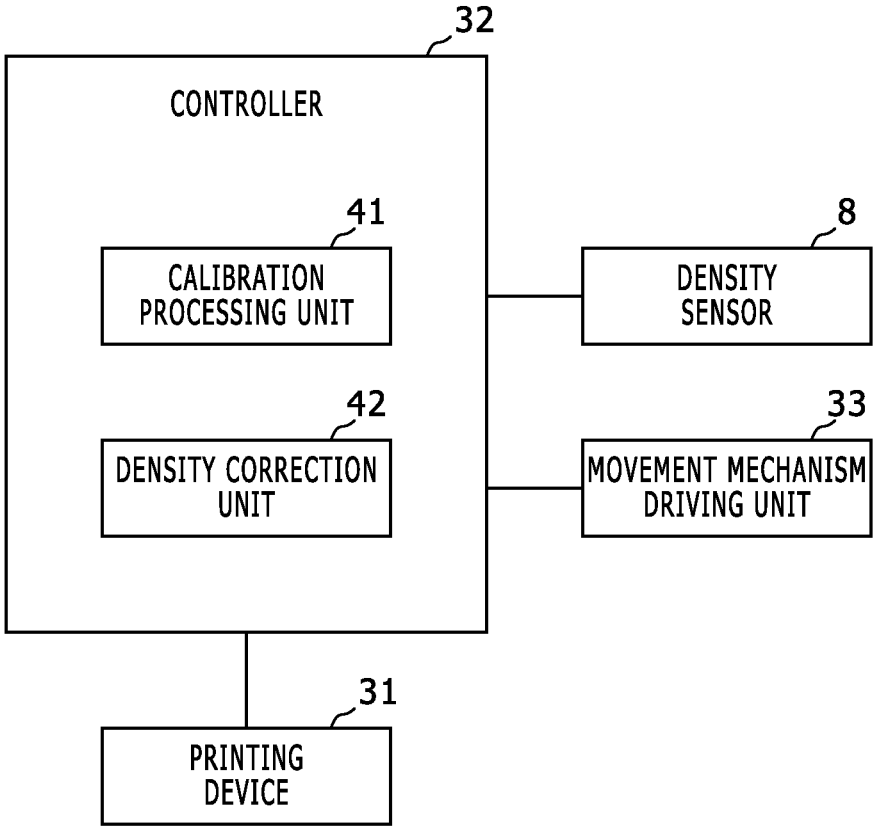
FIG. 3 shows a block diagram that indicates a part of an electronic configuration of the image forming apparatus in Embodiment 1.

FIG. 3 shows a block diagram that indicates a part of an electronic configuration of the image forming apparatus in Embodiment 1.

In Embodiment 1, the image forming apparatus includes a printing device 31 that has a mechanical configuration shown in FIGS. 1 and 2, a controller 32, and a movement mechanism driving unit 33 such as a motor that drives the aforementioned movement mechanism.

The controller 32 controls an unshown driving source that drives the aforementioned rollers and the like, a bias circuit that induces a primary transfer bias, the development devices 3*a* to 3*d*, the exposure devices 2*a* to 2*d* and the like, and thereby performs developing, transferring and fixing the toner image, feeding a paper sheet, printing on the paper sheet, and outputting the paper sheet. The primary transfer biases are applied between the photoconductor drums 1*a* to 1*d* and the intermediate transfer belt 4, respectively. The controller 32 includes a computer that acts in accordance with a control program, an ASIC (Application Specific Integrated Circuit) and/or the like, and acts as sorts of processing units. In this embodiment, the controller 32 acts as a calibration processing unit 41 and a density correction unit 42.

The calibration processing unit 41 performs a calibration process (adjustment of a highest toner density and/or an intermediate toner gradation level) periodically or at a predetermined timing.

The density correction unit 42 performs density correction so as to make a uniform density characteristic of the printing toner image in the primary scanning direction.

For example, due to an optical characteristic of the exposure devices 2*a* to 2*d*, even if exposure is performed with a constant light intensity in the primary scanning direction, a constant toner density is not obtained. Therefore, the density correction unit 42 performs density correction corresponding to a position in the primary scanning direction.

The density correction unit 42 corrects a value of image data or corrects a level of a driving signal for a light source of the exposure device 2*a*, 2*b*, 2*c* or 2*d* (i.e. corrects an exposure light intensity), and thereby performs the density correction.

The density correction unit 42 changes a strength of the density correction for a contact range (hereinafter, called "additional correction range") to which the cleaning device 11 (the aforementioned contact member 11*a*) contacts on the intermediate transfer belt 4 in the primary scanning direction. The density correction unit 42 changes the strength in accordance with the number of times of the calibration process from a usage starting time of the intermediate transfer belt 4 (i.e. from shipment of the image forming apparatus or replacement of the intermediate transfer belt 4).

Figure 4:
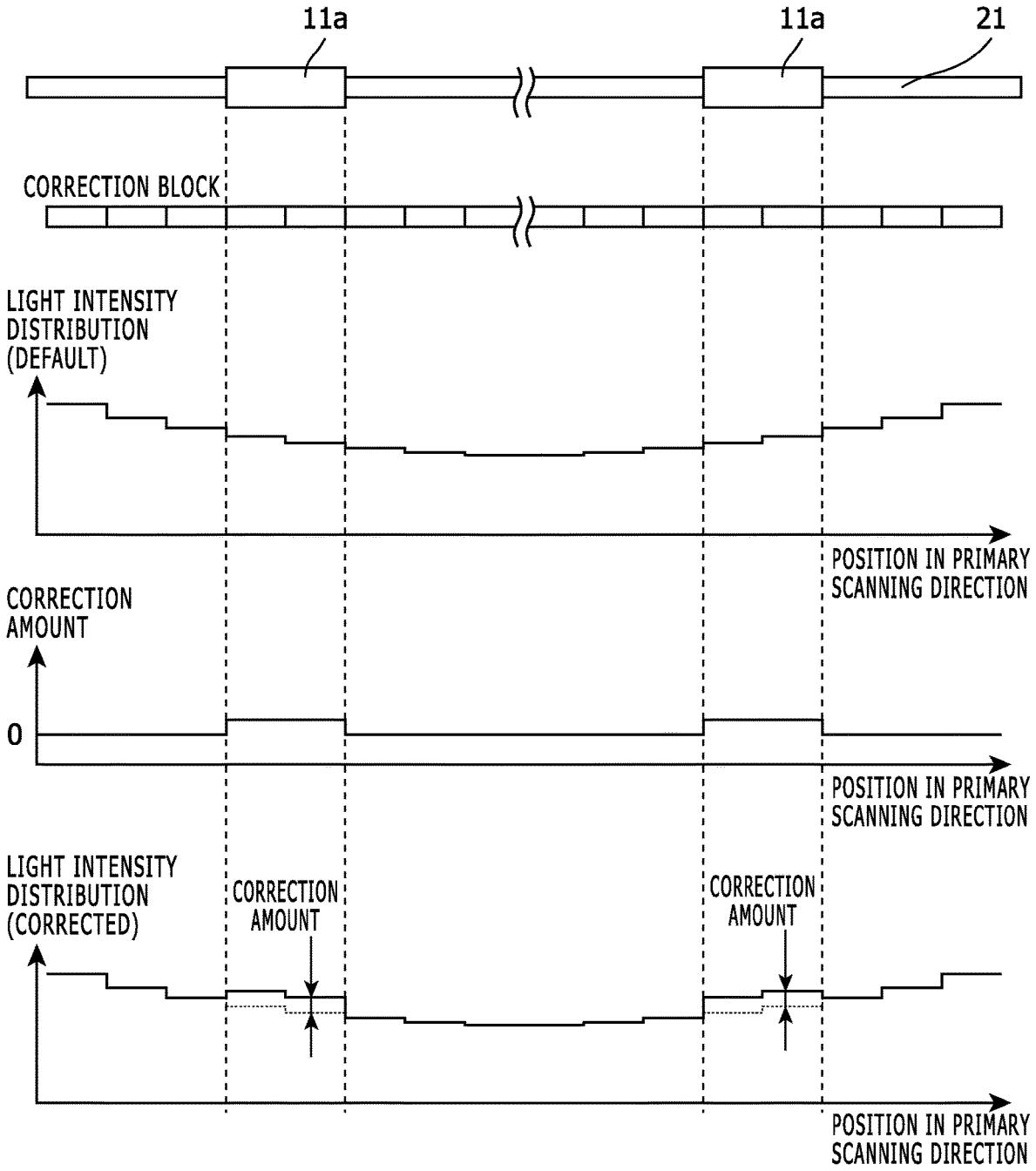
FIG. 4 shows a diagram that explains an example of density correction performed by a density correction unit 42 shown in FIG. 3.

FIG. 4 shows a diagram that explains an example of density correction performed by a density correction unit 42 shown in FIG. 3;

In Embodiment 1, in accordance with the aforementioned optical characteristic, the density correction unit 42 performs the density correction with respective intensities corresponding to a predetermined number (e.g. 16, 32 or 64) of correction blocks into which a printing image area in the primary scanning direction is divided, and thereby performs the density correction.

Further, in Embodiment 1, so that an end of the aforementioned additional correction range agrees with a boundary between the correction blocks, a length of the contact member 11*a* or a length of the correction block is set. Consequently, among correction amounts according to the aforementioned optical characteristic for the correction blocks, for a correction block corresponding to the additional correction range, a correction amount corresponding to the number of the calibration process is added, and the correction for a partial contact of the cleaning device 11 is easily performed (i.e. only one time of the light intensity correction is required).

For a larger number of times of the calibration process, higher exposure light intensity is set for the aforementioned additional correction range, and thereby the strength of the density correction for the aforementioned additional correction range is get higher. Consequently, on a printed matter, a low quality image is restrained in a part corresponding to the additional correction range.

The following part explains a behavior of the image forming apparatus in Embodiment 1.

(a) Behavior in the Calibration Process

Figure 13:
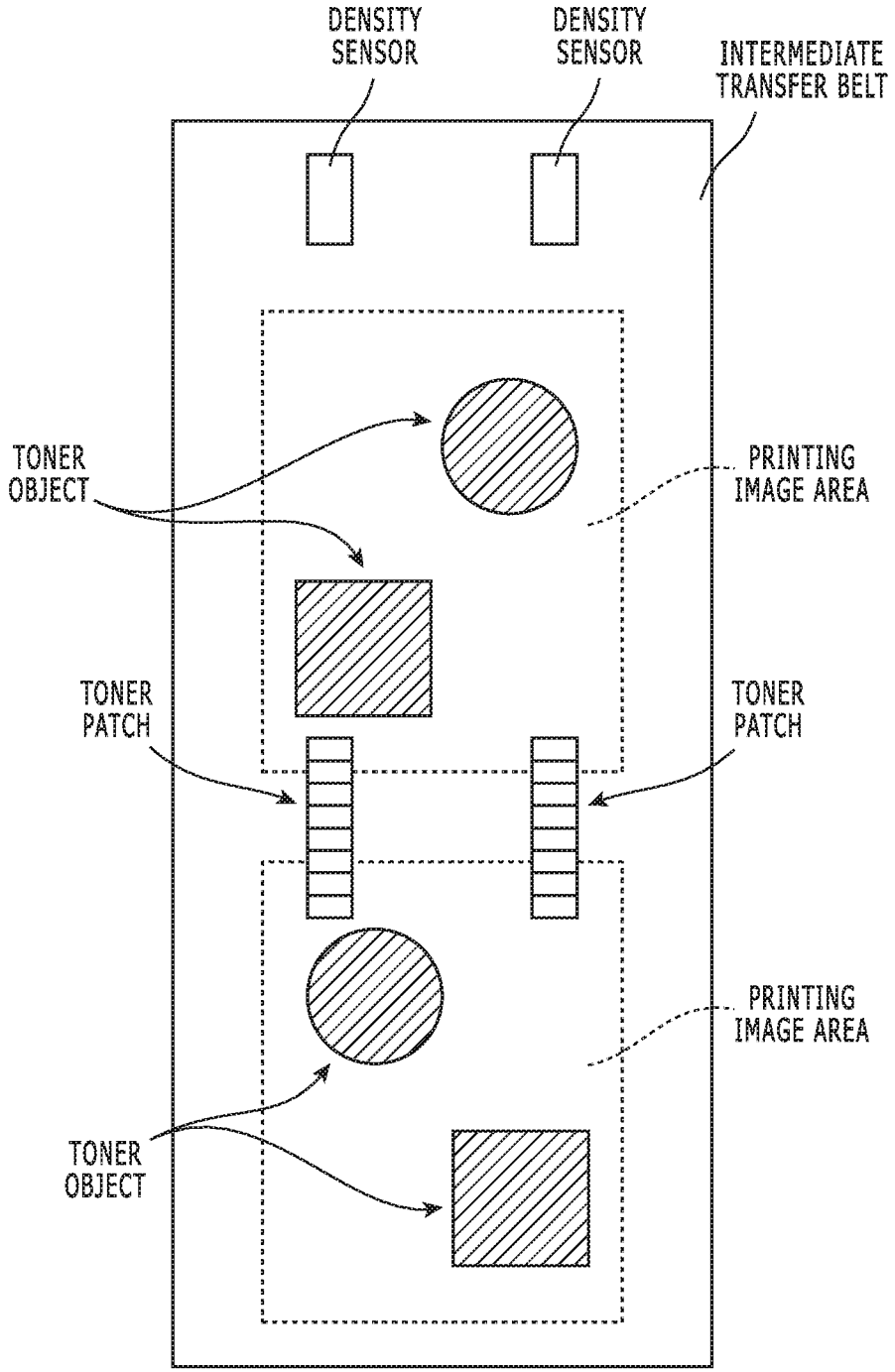
FIG. 13 shows a diagram that indicates an example of a position where a toner patch is carried on an intermediate transfer belt.
Figure 14:
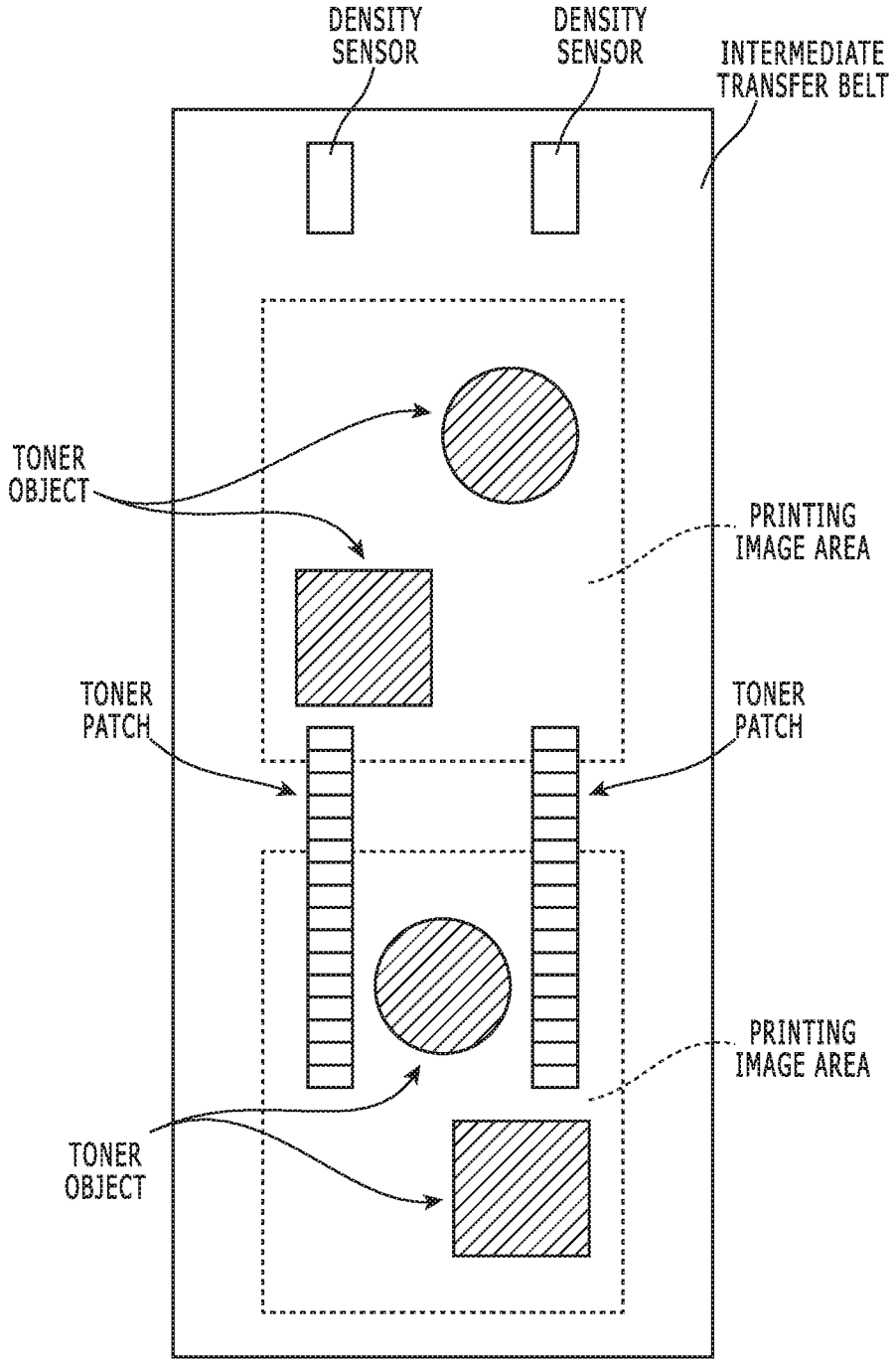
FIG. 14 shows a diagram that indicates another example of a position where a toner patch is carried on an intermediate transfer belt.
Figure 15:
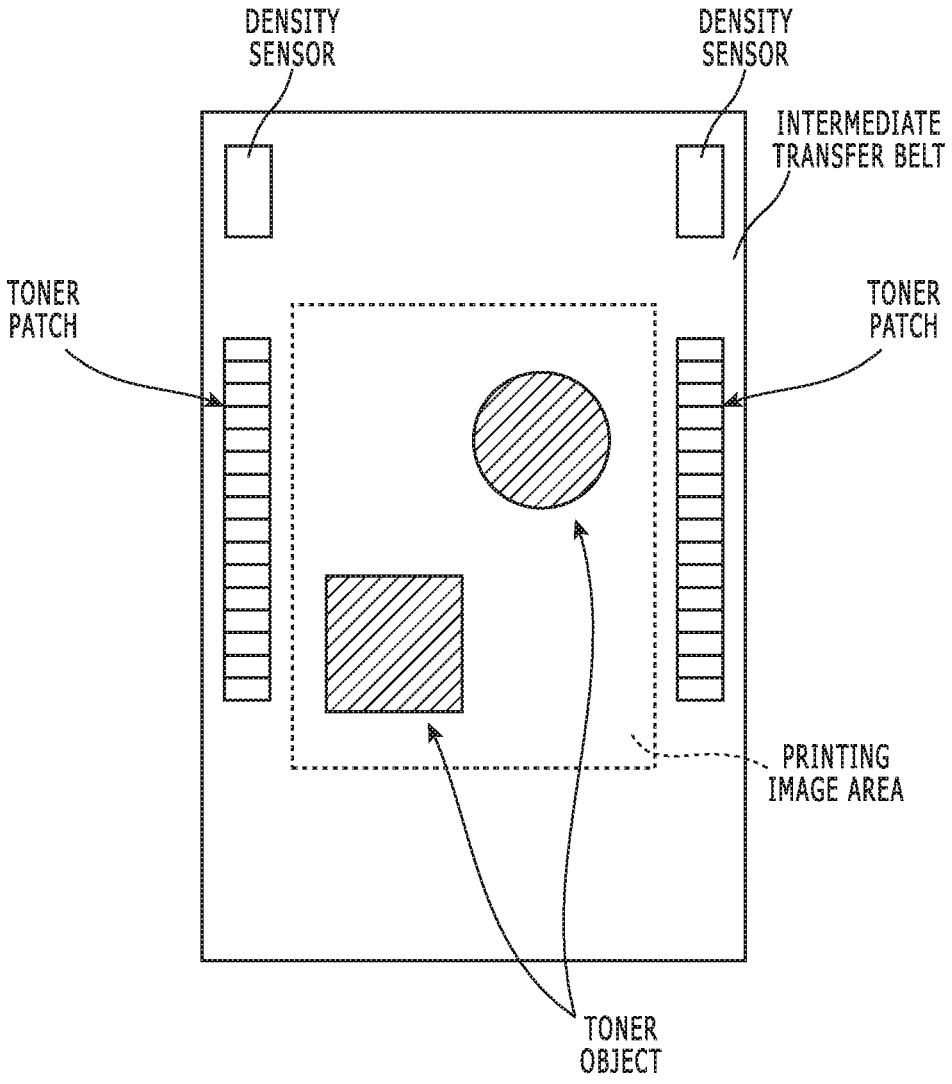
FIG. 15 shows a diagram that indicates another example of a position where a toner patch is carried on an intermediate transfer belt.

When coming an execution timing of the calibration process, the calibration processing unit 41 controls the printing device 31 and thereby (a) performs development of a calibration toner image using the exposure devices 2*a* to 2*d* and the development devices 3*a* to 3*d*, (b) performs primary transfer of the calibration toner image to the intermediate transfer belt 4 as shown in FIG. 13, 14 or 15 for example, and (c) detects the calibration toner image using the density sensor 8, determines a density of the calibration toner image on the basis of an output signal of the density sensor 8, and adjusts a toner density characteristic and a toner gradation characteristic on the basis of the determined density.

In this process, the calibration processing unit 41 controls the movement mechanism driving unit 33 and thereby contacts the cleaning device 11 to the intermediate transfer belt 4 and causes the cleaning device 11 to remove the calibration toner image. Here, the contact member 11*a* of the cleaning device 11 contacts to a part of the intermediate transfer belt 4 in the primary scanning direction.

After finishing the calibration process, the calibration processing unit 41 controls the movement mechanism driving unit 33 and thereby separates the cleaning device 11 from the intermediate transfer belt 4. Therefore, when performing a printing process, the cleaning device 11 is away from the intermediate transfer belt 4, and a printing toner image is not removed by the cleaning device 11.

Further, in an unshown non-volatile storage device, a counter value for counting the number of the calibration process is stored, and the calibration processing unit 41 updates the counter value by increasing it by 1 every time that the calibration process is performed. This counter value is set as zero at shipment, and reset as zero when the intermediate transfer belt 4 is replaced with a new one.

(b) Behavior in the Printing Process of an Image

When receiving a print request, the controller 32 obtains image data of the print request, and performs image processing required for the image data. In this process, on the basis of the counter value for the number of times of the calibration process, the density correction unit 42 performs density correction for the additional correction range in the primary scanning direction corresponding to the contact member 11*a* of the cleaning device 11. Subsequently, an image that the density correction was applied is printed by the printing device 31.

As mentioned, in Embodiment 1, the cleaning device 11 contacts to a part of the intermediate transfer belt 4 in a primary scanning direction and removes from the intermediate transfer belt 4 the calibration toner image that passed at a detection position of the density sensor 8. The density correction unit 42 performs density correction of a printing toner image in the primary scanning direction. Specifically, the density correction unit 42 changes a strength of the density correction for a contact range to which the cleaning device contacts on the intermediate transfer belt 4 in accordance with the number of times of the calibration process.

Consequently, even though a partial contact occurs between the intermediate transfer belt 4 and the cleaning device 11 that removes the calibration toner image, a low quality image due to the partial contact on a printed matter is restrained.

For example, even if a secondary transfer rate of a contact portion decreases more largely than that of a non-contact portion due to the partial contact of the cleaning device 11 in the calibration process, this density correction restrains a low quality image on a printed matter (i.e. a toner image transferred secondarily).

Embodiment 2

Figure 5:
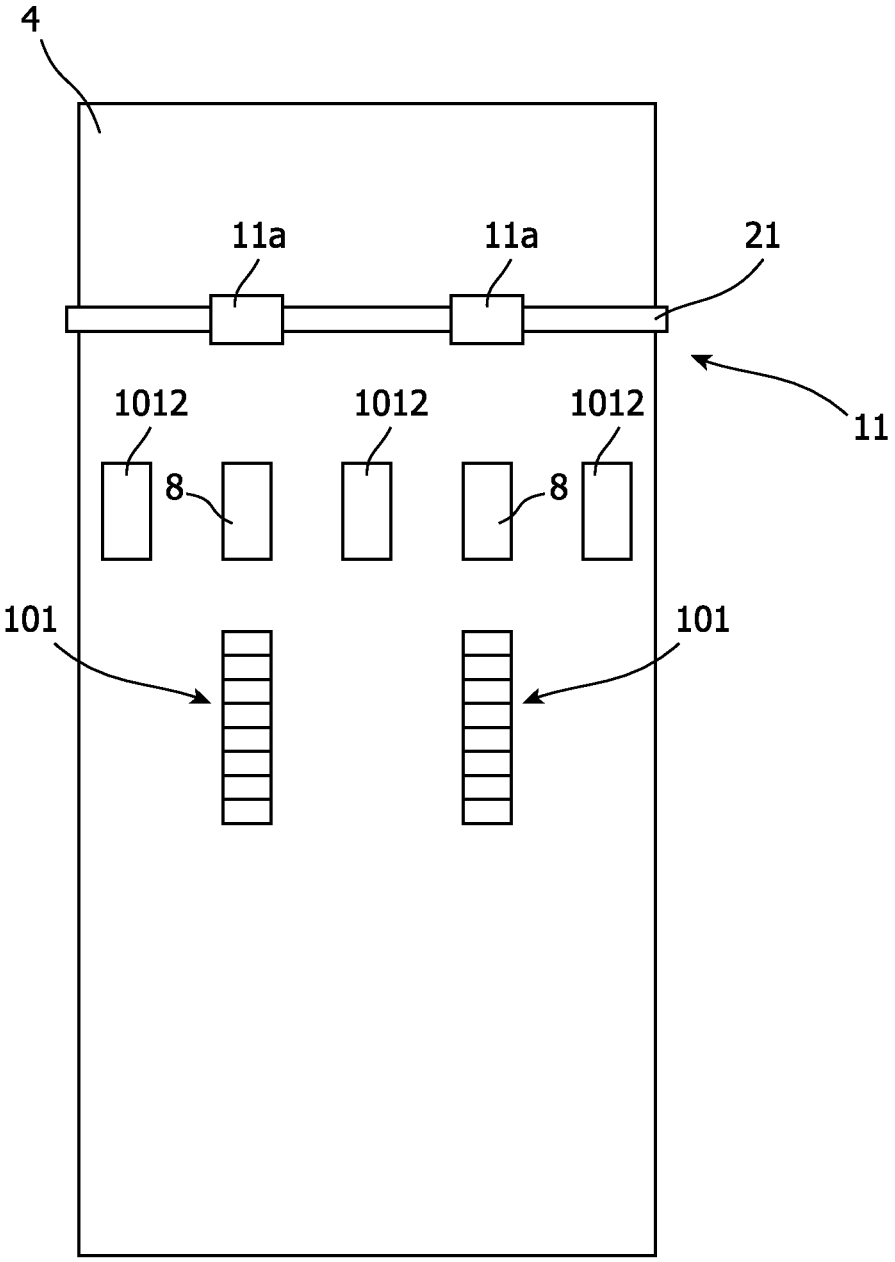
FIG. 5 shows a diagram that indicates an example of a cleaning device 11 in Embodiment 2.

FIG. 5 shows a diagram that indicates an example of a cleaning device 11 in Embodiment 2. The cleaning device 11 shown in FIG. 5 includes a cleaning roller 21, and the cleaning roller 21 includes two cylindrical contact members 11*a*. The calibration toner images 101 that passed at a detection position of the sensor 8 are removed by the contact members 11*a*. Toner removed by the contact members 11*a* is collected and disposed from the contact members 11*a* by an unshown collection mechanism.

A sensor 8 is a reflection-type optical sensor, and irradiates with light a predetermined first position at which the calibration toner image passes and receives reflection light from the first position (i.e. from a surface material of the intermediate transfer belt 4 at the first position), and outputs an electronic signal corresponding to an intensity of the received reflection light. A sensor 1012 is a reflection-type optical sensor, and irradiates with light a predetermined second position other than a range where the cleaning device 11 contacts to the intermediate transfer belt 4, receives its reflection light from the second position (i.e. from a surface material of the intermediate transfer belt 4 at the second position), and outputs an electronic signal corresponding to an intensity of the received reflection light. In FIG. 5, the sensors 1012 are arranged in a range between the two sensors and in an outside range of the two sensors 8. Alternatively, the sensor 1012 may be arranged only in a range between the two sensors 8. Alternatively, the sensor 1012 may be arranged only in an outside range of the two sensors 8.

Figure 6:
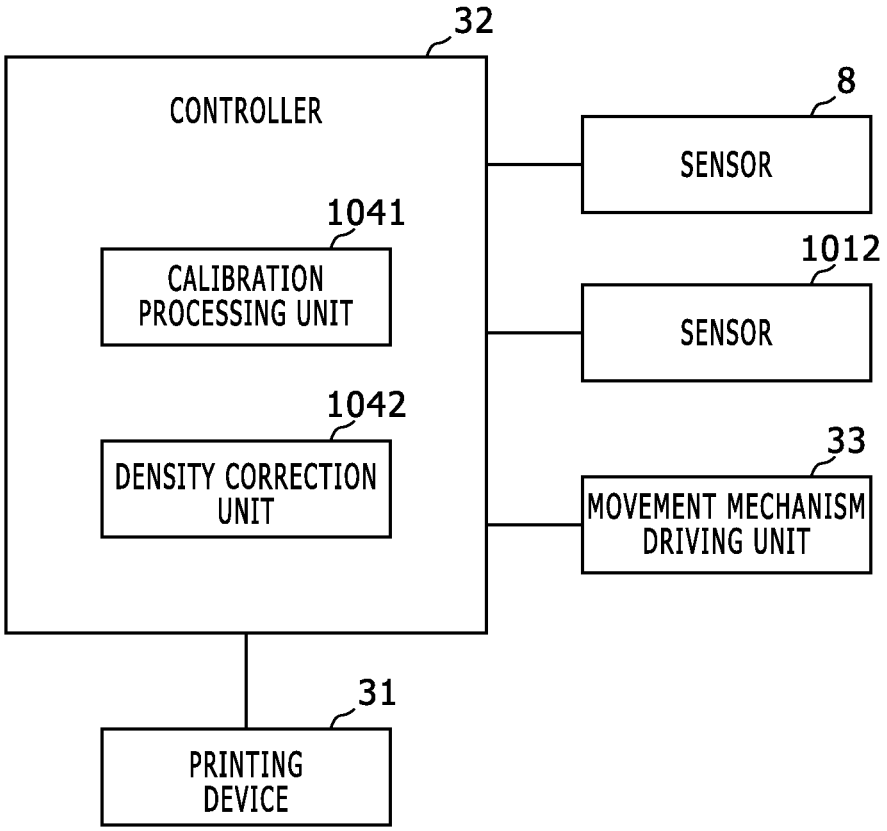
FIG. 6 shows a block diagram that indicates a part of an electronic configuration of the image forming apparatus in Embodiment 2.

FIG. 6 shows a block diagram that indicates a part of an electronic configuration of the image forming apparatus in Embodiment 2.

In Embodiment 2, the image forming apparatus includes a printing device 31 that has a mechanical configuration shown in FIGS. 1 and 5, a controller 32, and a movement mechanism driving unit 33 such as a motor that drives the aforementioned movement mechanism.

The controller 32 controls an unshown driving source that drives the aforementioned rollers and the like, a bias circuit that induces a primary transfer bias, the development devices 3*a* to 3*d*, the exposure devices 2*a* to 2*d* and the like, and thereby performs developing, transferring and fixing the toner image, feeding a paper sheet, printing on the paper sheet, and outputting the paper sheet. The primary transfer biases are applied between the photoconductor drums 1*a* to 1*d* and the intermediate transfer belt 4, respectively. The controller 32 includes a computer that acts in accordance with a control program, an ASIC and/or the like, and acts as sorts of processing units. In this embodiment, the controller 32 acts as a calibration processing unit 1041 and a density correction unit 1042.

The calibration processing unit 1041 performs a calibration process (adjustment of a highest toner density and/or an intermediate toner gradation level) periodically or at a predetermined timing.

The calibration processing unit 1041 determines a density of each toner patch on the basis of an output signal of the sensor 8 corresponding to the calibration toner image, and performs a calibration process based on the determined density.

The density correction unit 1042 performs density correction so as to make a uniform density characteristic of the printing toner image in the primary scanning direction.

For example, due to an optical characteristic of the exposure devices 2*a* to 2*d*, even if exposure is performed with a constant light intensity in the primary scanning direction, a constant toner density is not obtained. Therefore, the density correction unit 1042 performs density correction corresponding to a position in the primary scanning direction.

The density correction unit 1042 corrects a value of image data or corrects a level of a driving signal for a light source of the exposure device 2*a*, 2*b*, 2*c* or 2*d* (i.e. corrects an exposure light intensity), and thereby performs the density correction.

The density correction unit 1042 changes a strength of the density correction in the contact range (hereinafter, called "additional correction range") to which the cleaning device 11 (the aforementioned contact member 11*a*) contacts on the intermediate transfer belt 4 in the primary scanning direction on the basis of (a) an output signal of the sensor 8 and (b) an output signal of the optical sensor 1012. The output signal of the sensor 8 corresponds to a surface material of the intermediate transfer belt 4 at the aforementioned first position, and the output signal of the sensor 1012 corresponds to a surface material of the intermediate transfer belt 4 at the aforementioned second position.

Here, the density correction unit 1042 determines a density correction amount on the basis of a difference or a ratio between (a) a level of the output signal of the sensor 8 corresponding to a surface material of the intermediate transfer belt 4 at the aforementioned first position and (b) a level of the output signal of the sensor 1012 corresponding to a surface material of the intermediate transfer belt 4 at the aforementioned second position.

If the plural sensors 1012 are installed, for determining a density correction amount of the additional correction range corresponding to each sensor 8, an average value of the output signal levels of the sensors 1012 arranged in the both sides of each sensor 8 may be used as the aforementioned level of the output signal of the sensor 1012 or an output signal level of the sensor 1012 nearest to each sensor 8 may be used as the aforementioned level of the output signal of the sensor 1012.

Further, regarding a level of the output signal of the sensor 8 corresponding to a surface material of the intermediate transfer belt 4 at the aforementioned first position, if a level of the output signal of the sensor 8 corresponding to a surface material of the intermediate transfer belt 4 at the aforementioned first position has been detected in order to determine a density of the calibration toner image in the calibration process, then the detected output signal level in the calibration process may be used to determine the density correction amount of the additional correction range.

Figure 7:
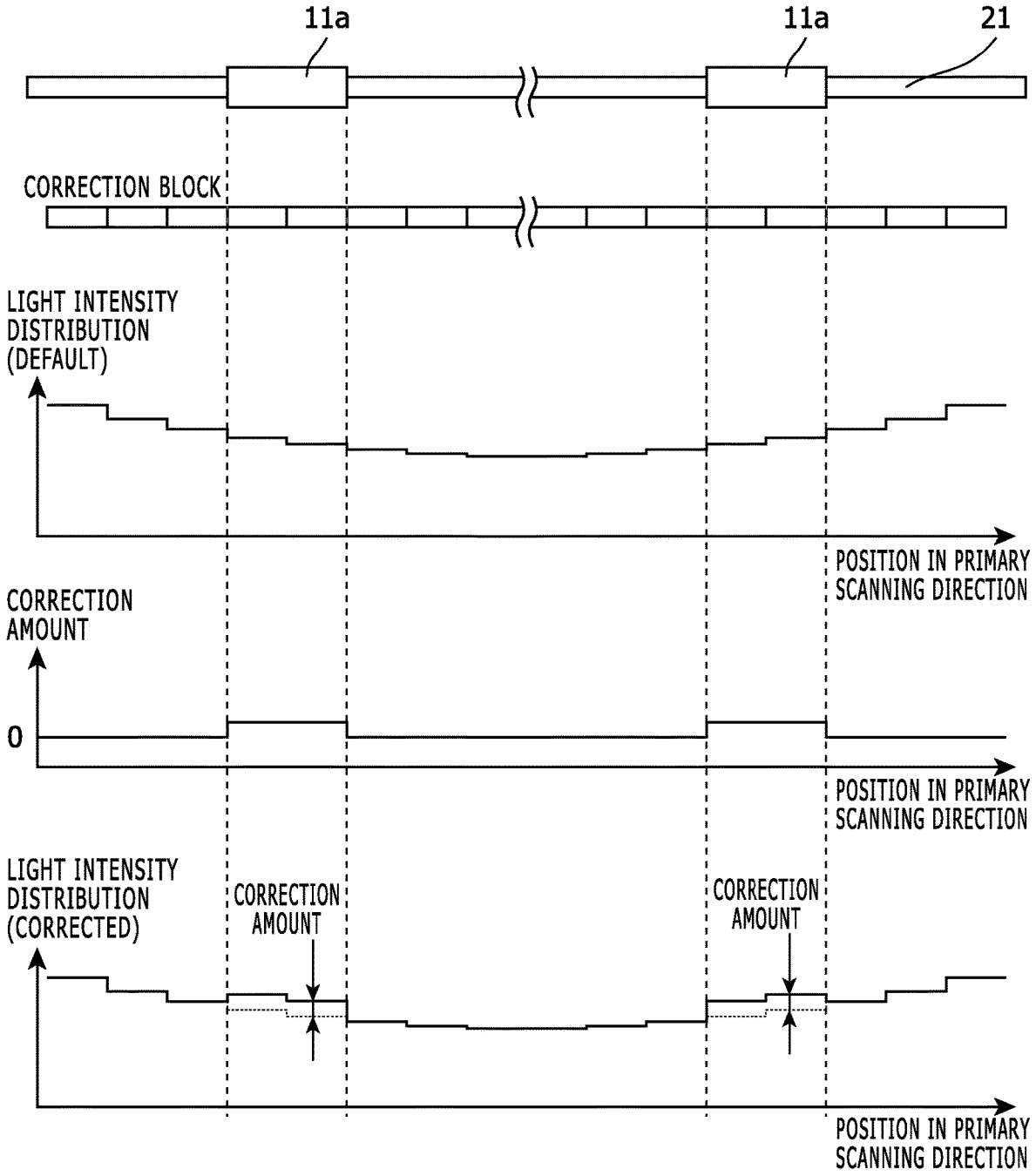
FIG. 7 shows a diagram that explains an example of density correction performed by a density correction unit 1042 shown in FIG. 6.

FIG. 7 shows a diagram that explains an example of density correction performed by the density correction unit 1042 shown in FIG. 6.

In Embodiment 2, in accordance with the aforementioned optical characteristic, the density correction unit 1042 performs the density correction with respective intensities corresponding to a predetermined number (e.g. 16, 32 or 64) of correction blocks into which a printing image area in the primary scanning direction is divided, and thereby performs the density correction.

Further, in Embodiment 2, so that an end of the aforementioned additional correction range agrees with a boundary between the correction blocks, a length of the contact member 11*a* or a length of the correction block is set. Consequently, among correction amounts according to the aforementioned optical characteristic for the correction blocks, for a correction block corresponding to the additional correction range, a correction amount corresponding to the aforementioned difference or ratio is added, and the correction for a partial contact of the cleaning device 11 is easily performed (i.e. only one time of the light intensity correction is required).

For a lower level of the output signal of the sensor 8 corresponding to a surface material of the intermediate transfer belt 4 at the aforementioned first position in comparison with a level of the output signal of the sensor 1012 corresponding to a surface material of the intermediate transfer belt 4 at the aforementioned second position, a higher exposure light intensity is set for the aforementioned additional correction range, and thereby the strength of the density correction for the aforementioned additional correction range is get higher. Consequently, on a printed matter, a low quality image is restrained in a part corresponding to the additional correction range.

Other parts of the configuration and behaviors of the image forming apparatus in Embodiment 2 are identical or similar to those in Embodiment 1, and therefore not explained here.

The following part explains a behavior of the image forming apparatus in Embodiment 2.

(a) Behavior in the Calibration Process

When coming an execution timing of the calibration process, the calibration processing unit 1041 controls the printing device 31 and thereby (a) performs development of a calibration toner image using the exposure devices 2*a* to 2*d* and the development devices 3*a* to 3*d*, (b) performs primary transfer of the calibration toner image to the intermediate transfer belt 4 as shown in FIG. 13, 14 or 15 for example, and (c) detects the calibration toner image using the sensor 8, determines a density of the calibration toner image on the basis of an output signal of the sensor 8, and adjusts a toner density characteristic and a toner gradation characteristic on the basis of the determined density.

In this process, the calibration processing unit 1041 controls the movement mechanism driving unit 33 and thereby contacts the cleaning device 11 to the intermediate transfer belt 4 and causes the cleaning device 11 to remove the calibration toner image. Here, the contact member 11*a* of the cleaning device 11 contacts to a part of the intermediate transfer belt 4 in the primary scanning direction.

After finishing the calibration process, the calibration processing unit 1041 controls the movement mechanism driving unit 33 and thereby separates the cleaning device 11 from the intermediate transfer belt 4. Therefore, when performing a printing process, the cleaning device 11 is away from the intermediate transfer belt 4, and a printing toner image is not removed by the cleaning device 11.

Further, for example, in the calibration process, the calibration processing unit 1041 determines a level of the output signal of the sensor 8 corresponding to a surface material of the intermediate transfer belt 4 at the aforementioned first position and a level of the output signal of the sensor 1012 corresponding to a surface material of the intermediate transfer belt 4 at the aforementioned second position, and stores the determined levels in an unshown non-volatile storage device.

At a timing other than the calibration process, the controller 32 may determine a level of the output signal of the sensor 8 corresponding to a surface material of the intermediate transfer belt 4 at the aforementioned first position and a level of the output signal of the sensor 1012 corresponding to a surface material of the intermediate transfer belt 4 at the aforementioned second position, and store the determined levels in an unshown non-volatile storage device.

(b) Behavior in the Printing Process of an Image

When receiving a print request, the controller 32 obtains image data of the print request, and performs image processing required for the image data. In this process, the density correction unit 1042 reads the level of the output signal of the sensor 8 corresponding to a surface material of the intermediate transfer belt 4 at the aforementioned first position and the level of the output signal of the sensor 1012 corresponding to a surface material of the intermediate transfer belt 4 at the aforementioned second position from the unshown non-volatile storage device, and on the basis of the read levels, performs the density correction of the additional correction range in the primary scanning direction corresponding to the contact member 11*a* of the cleaning device 11. Subsequently, an image that the density correction was applied is printed by the printing device 31.

As mentioned, in Embodiment 2, the sensor 8 irradiates with light a predetermined first position at which the calibration toner image passes and receives reflection light from the first position. The calibration processing unit 1041 performs a calibration process based on an output signal of the sensor 8 corresponding to the calibration toner image. The cleaning device 11 contacts to a part of the intermediate transfer belt 4 in a primary scanning direction and removes from the intermediate transfer belt 4 the calibration toner image that passed at the first position. The sensor 1012 irradiates with light a predetermined second position and receives reflection light from the second position and the second position is a position other than a contact range to which the cleaning device 11 contacts on the intermediate transfer belt 4. The density correction unit 1042 performs density correction of a printing toner image in the primary scanning direction. Specifically, the density correction unit 1042 changes a strength of the density correction in the contact range on the basis of (a) an output signal of the sensor 8 and (b) an output signal of the optical sensor 1012. The output signal of the sensor 8 corresponds to a surface material of the intermediate transfer belt 4 at the aforementioned first position, and the output signal of the sensor 1012 corresponds to a surface material of the intermediate transfer belt 4 at the aforementioned second position.

Consequently, even though a partial contact occurs between the intermediate transfer belt 4 and the cleaning device 11 that removes the calibration toner image, a low quality image due to the partial contact on a printed matter is restrained.

For example, even if a secondary transfer rate of a contact portion decreases more largely than that of a non-contact portion due to the partial contact of the cleaning device 11 in the calibration process, this density correction restrains a low quality image on a printed matter (i.e. a toner image transferred secondarily).

Embodiment 3

Figure 8:
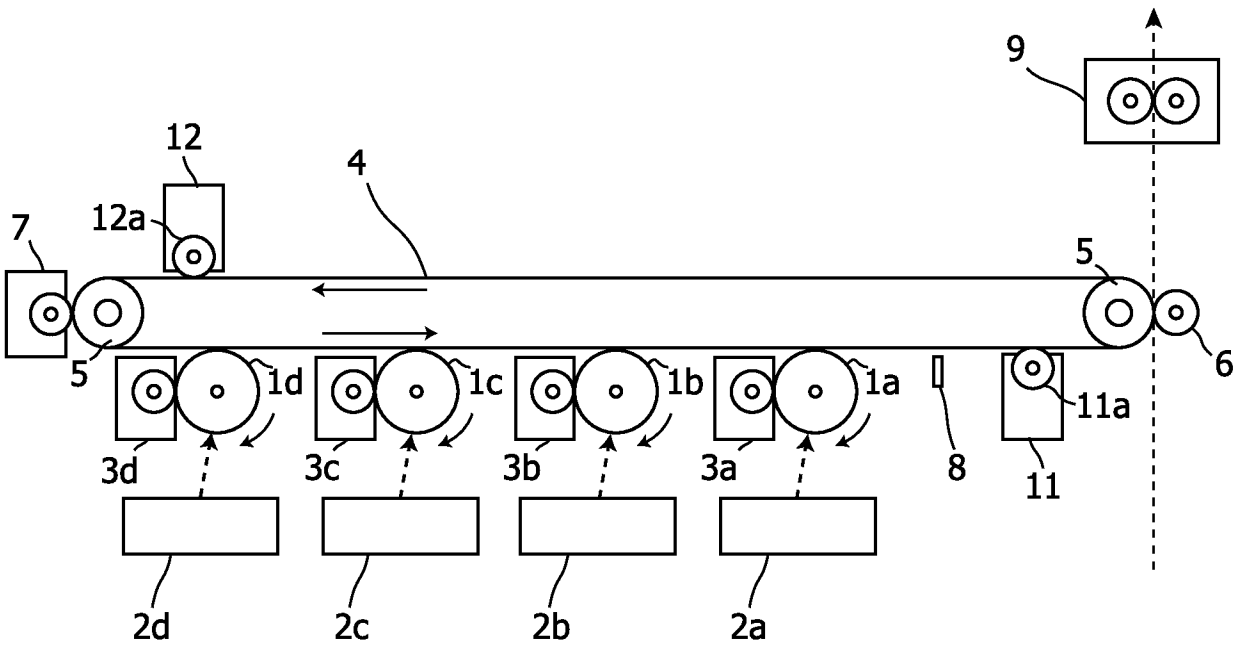
FIG. 8 shows a side view that indicates an internal mechanical configuration of an image forming apparatus in Embodiment 3.

FIG. 8 shows a side view that indicates an internal mechanical configuration of an image forming apparatus in Embodiment 3. In Embodiment 3, a cleaning device 11 is arranged between the density sensor 8 and the secondary transfer roller 6, and contacts only to a predetermined contact range as a part (a part of a width of a printing image area, that is, a part of an upper limit width of the printing toner image) of the intermediate transfer belt 4 in the primary scanning direction in the calibration process by means of an unshown movement mechanism, and thereby removes the calibration toner image that passed at a detection position of the density sensor 8. Consequently, the calibration toner image is not secondarily transferred. Thus, the calibration toner image is formed within a transferable area of the secondary transfer roller 6, but removed by the cleaning device 11.

For example, as shown in FIG. 14, even if the intermediate transfer belt 4 carries a printing toner image and a calibration toner image in parallel along the secondary scanning direction, the cleaning device 11 removes the calibration toner image so as not to remove the printing toner image (a toner object).

The cleaning device 11 includes a contact member 11*a* such as a roller, a blade or a brush, and by means of an unshown movement mechanism, the contact member 11*a* is contacted to the intermediate transfer belt 4. In the primary scanning direction, a length of the contact member 11*a* is (a) equal to or longer than a width of the calibration toner image and (b) shorter than a width of the printing image area (i.e. the upper limit width of the printing toner image). It should be noted that as the calibration toner image, a predetermined number of toner patch sequences are formed along the secondary scanning direction. The number of the contact members 11*a* is equal to the number of the calibration toner images arranged along the primary scanning direction (i.e. the number of the toner patch sequences).

In Embodiment 3, a cleaning device 12 is arranged between the secondary transfer roller 6 and the cleaning device 7, and is contacted to a range other than the aforementioned contact range of the intermediate transfer belt 4 in the primary scanning direction in the calibration process by means of an unshown movement mechanism. Specifically, in the primary scanning direction, in the printing image area, the cleaning device 12 contacts to a range (hereinafter, called "supplemental contact range") other than the contact range that the cleaning device 11 contacts to.

Thus, in a movement direction of the intermediate transfer belt 4, the cleaning device 11 is arranged in an upstream side of the secondary transfer roller 6, and the cleaning device 12 is arranged in a downstream side of the secondary transfer roller 6.

The cleaning device 12 includes a contact member 12*a* such as a roller, a blade or a brush, and by means of an unshown movement mechanism, the contact member 12*a* is contacted to the supplemental contact range of the intermediate transfer belt 4.

The cleaning device 11 is separated from the intermediate transfer belt 4 when the intermediate transfer belt 4 carries a printing toner image in the aforementioned contact range, and the cleaning device 12 is separated from the intermediate transfer belt 4 together with the cleaning device 11.

The cleaning device 12 may make contact to the intermediate transfer belt 4 at the same timing that the cleaning device 11 makes contact to the intermediate transfer belt 4, and the cleaning device 12 may release the contact to the intermediate transfer belt 4 at the same timing that the cleaning device 11 releases the contact to the intermediate transfer belt 4.

Further, in the secondary scanning direction, the cleaning device 12 contacts to a same range as a range that the cleaning device 11 contacts to. In such a case, after completing the contact of the cleaning device 11, the secondary scanning directional range that the cleaning device 11 contacts to on the intermediate transfer belt 4 moves toward an arrangement position of the cleaning device 12, and when this secondary scanning directional range reaches a position where the cleaning device 12 is arranged, the cleaning device 12 contacts to the supplemental contact range in this secondary scanning directional range.

Figure 9:
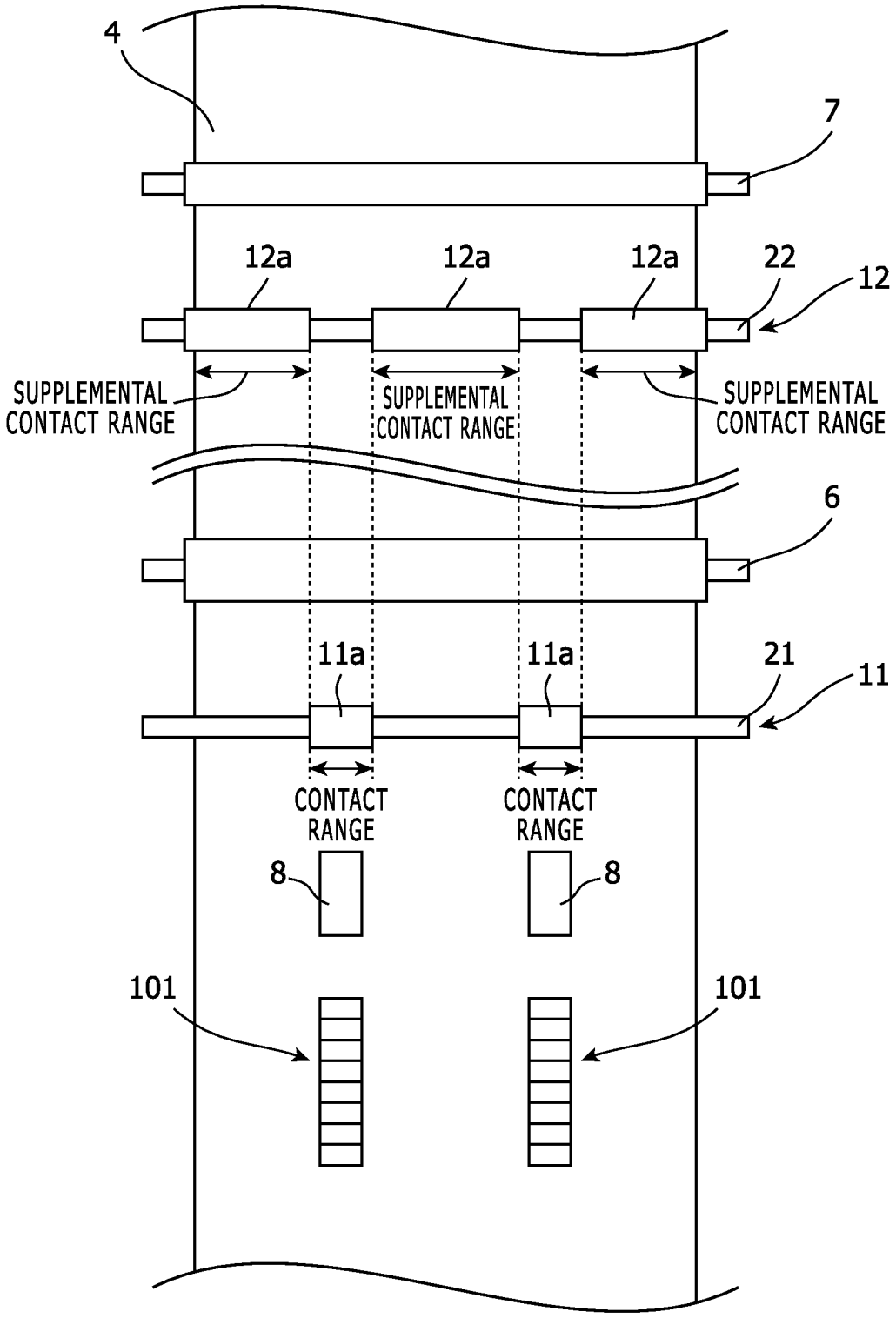
FIG. 9 shows a diagram that indicates an example of cleaning devices 11 and 12 in Embodiment 3.

FIG. 9 shows a diagram that indicates an example of the cleaning devices 11 and 12 in Embodiment 3. The cleaning device 11 shown in FIG. 9 includes a cleaning roller 21, and the cleaning roller 21 includes two cylindrical contact members 11*a*. The cleaning device 12 shown in FIG. 9 includes a cleaning roller 22, and the cleaning roller 22 includes three cylindrical contact members 12*a*. The contact member 12*a* is the same as the contact member 11*a*, and has the same shape and is made of the same material as those of the contact member 11*a*.

The calibration toner images 101 that passed at a detection position of the density sensor 8 are removed by the contact members 11*a*. Toner removed by the contact members 11*a* is collected and disposed from the contact members 11*a* by an unshown collection mechanism.

Further, the contact member 12*a* of the cleaning device contacts to the supplemental contact range the same number of times as the number of times that the contact member 11*a* of the cleaning device 11 contacts to the contact range.

Figure 10:
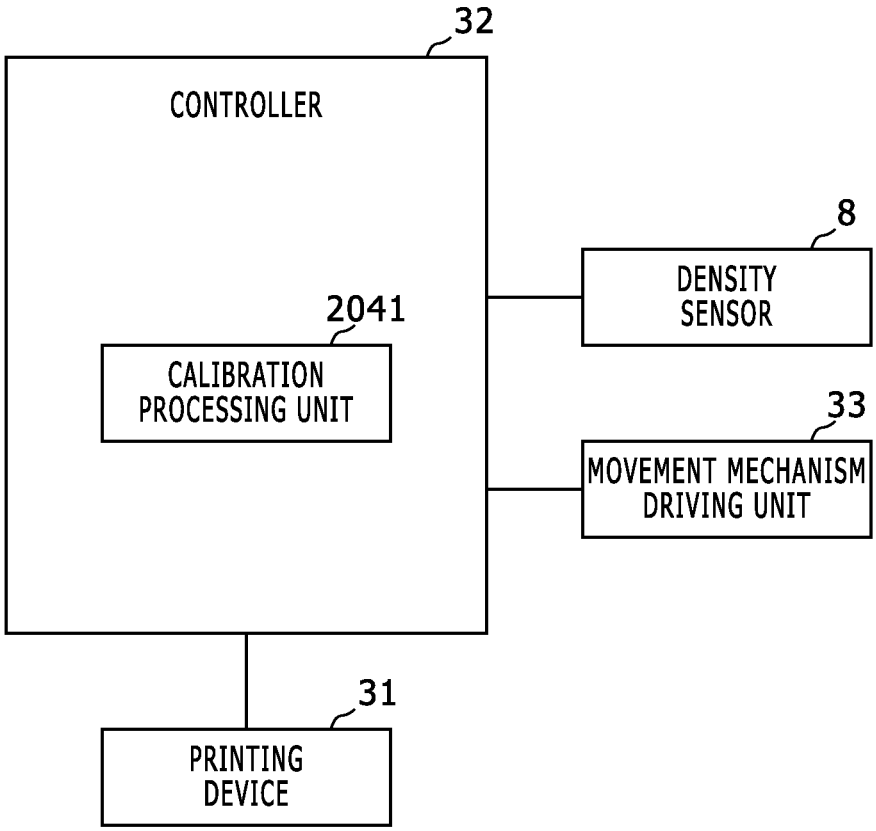
FIG. 10 shows a block diagram that indicates a part of an electronic configuration of the image forming apparatus in Embodiment 3.

FIG. 10 shows a block diagram that indicates a part of an electronic configuration of the image forming apparatus in Embodiment 3.

In Embodiment 3, the image forming apparatus includes a printing device 31 that has a mechanical configuration shown in FIGS. 8 and 9, a controller 32, and a movement mechanism driving unit 33 such as a motor that drives the aforementioned movement mechanism of the cleaning rollers 21 and 22.

The controller 32 controls an unshown driving source that drives the aforementioned rollers and the like, a bias circuit that induces a primary transfer bias, the development devices 3*a* to 3*d*, the exposure devices 2*a* to 2*d* and the like, and thereby performs developing, transferring and fixing the toner image, feeding a paper sheet, printing on the paper sheet, and outputting the paper sheet. The primary transfer biases are applied between the photoconductor drums 1*a* to 1*d* and the intermediate transfer belt 4, respectively. The controller 32 includes a computer that acts in accordance with a control program, an ASIC and/or the like, and acts as sorts of processing units. In Embodiment 3, the controller 32 acts as a calibration processing unit 2041. The calibration processing unit 2041 performs a calibration process (adjustment of a highest toner density and/or an intermediate toner gradation level) periodically or at a predetermined timing.

Other parts of the configuration and behaviors of the image forming apparatus in Embodiment 3 are identical or similar to those in Embodiment 1, and therefore not explained here.

The following part explains a behavior of the image forming apparatus in Embodiment 3.

When coming an execution timing of the calibration process, the calibration processing unit 2041 controls the printing device 31 and thereby (a) performs development of a calibration toner image using the exposure devices 2*a* to 2*d* and the development devices 3*a* to 3*d*, (b) performs primary transfer of the calibration toner image to the intermediate transfer belt 4 as shown in FIG. 13, 14 or 15 for example, and (c) detects the calibration toner image using the density sensor 8, determines a density of the calibration toner image on the basis of an output signal of the density sensor 8, and adjusts a toner density characteristic and a toner gradation characteristic on the basis of the determined density.

In this process, the calibration processing unit 2041 controls the movement mechanism driving unit 33 and thereby contacts the cleaning devices 11 and 12 to the intermediate transfer belt 4 and causes the cleaning device 11 to remove the calibration toner image. Here, the contact member 11*a* of the cleaning device 11 contacts to the contact range of the intermediate transfer belt 4. The contact member 12*a* of the cleaning device 12 contacts to the supplemental contact range of the intermediate transfer belt 4.

Consequently, when performing the calibration process, the contact members 11*a* and 12*a* contact to the contact range and the supplemental contact range uniformly in the primary scanning direction, and therefore, a surface condition of the intermediate transfer belt 4 similarly changes both in the contact range of the cleaning device 11 and in the other range.

As mentioned, in Embodiment 3, the cleaning device 11 contacts to a predetermined contact range of the intermediate transfer belt 4 in a primary scanning direction in the calibration process and removes from the intermediate transfer belt 4 the calibration toner image that passed at a detection position of the density sensor 8. The cleaning device 12 contacts to a residual range other than the predetermined contact range of the intermediate transfer belt 4 in a primary scanning direction in the calibration.

Consequently, even though a partial contact occurs between the intermediate transfer belt 4 and the cleaning device 11 that removes the calibration toner image, a low quality image due to the partial contact on a printed matter is restrained.

For example, even if a secondary transfer rate of the contact range decreases due to the partial contact of the cleaning device 11 in the calibration process, a secondary transfer rate of the other range (i.e. the supplemental contact range) than the contact range similarly decreases, and therefore, a difference of density characteristic in the primary scanning direction is restrained, and a low quality image on a printed matter (i.e. a toner image transferred secondarily) is restrained.

Embodiment 4

In Embodiment 4, a cleaning device 11 is arranged between the density sensor 8 and the secondary transfer roller 6, and contacts only to a part (a part of a width of a printing image area, that is, a part of an upper limit width of the printing toner image) of the intermediate transfer belt 4 in the primary scanning direction in the calibration process by means of an unshown movement mechanism, and thereby removes the calibration toner image that passed at a detection position of the density sensor 8. Consequently, the calibration toner image is not secondarily transferred. Thus, the calibration toner image is formed within a transferable area of the secondary transfer roller 6, but removed by the cleaning device 11.

For example, as shown in FIG. 14, even if the intermediate transfer belt 4 carries a printing toner image and a calibration toner image in parallel along the secondary scanning direction, the cleaning device 11 removes the calibration toner image so as not to remove the printing toner image (a toner object).

In Embodiment 4, the cleaning device 11 includes a contact member 11*a* such as a roller, a blade or a brush, and by means of an unshown movement mechanism, the contact member 11*a* is contacted to the intermediate transfer belt 4. In the primary scanning direction, a length of the contact member 11*a* is (a) equal to or longer than a width of the calibration toner image and (b) shorter than a width of the printing image area (i.e. the upper limit width of the printing toner image). It should be noted that as the calibration toner image, a predetermined number of toner patch sequences are formed along the secondary scanning direction. The number of the contact members 11*a* is equal to the number of the calibration toner images arranged along the primary scanning direction (i.e. the number of the toner patch sequences).

In Embodiment 1, the cleaning device 11 is separated from the intermediate transfer belt 4 when the intermediate transfer belt 4 carries a printing toner image in the contact range of the contact member 11*a* on the intermediate transfer belt 4.

Figure 11:
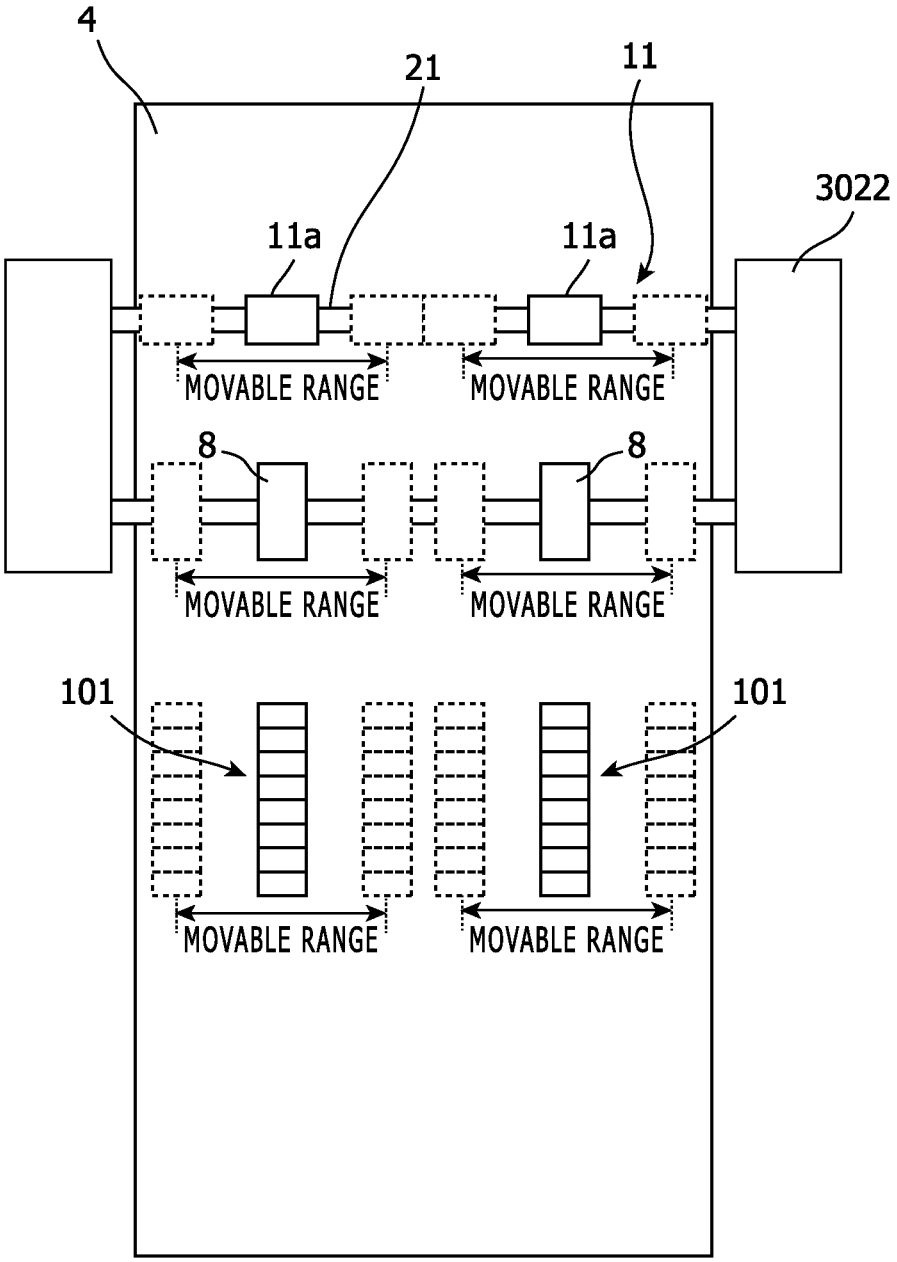
FIG. 11 shows a diagram that indicates an example of a cleaning device 11 in Embodiment 4.

FIG. 11 shows a diagram that indicates an example of a cleaning device 11 in Embodiment 4. The cleaning device 11 shown in FIG. 11 includes a cleaning roller 21, and the cleaning roller 21 includes two cylindrical contact members 11*a*.

As shown in FIG. 11, the density sensor 8 is fixed to a shaft and an actuator 3022 moves the cleaning roller 21 and the shaft of the density sensor 8 in the primary scanning direction. The actuator 3022 is, for example, a linear actuator as a combination of a motor and a ball screw, a rack and pinion driven by a motor, or the like.

The calibration toner images 101 that passed at a detection position of the density sensor 8 are removed by the contact members 11*a*. Toner removed by the contact members 11*a* is collected and disposed from the contact members 11*a* by an unshown collection mechanism.

Other parts of the configuration and behaviors of the image forming apparatus in Embodiment 4 are identical or similar to those in Embodiment 1, and therefore not explained here.

Figure 12:
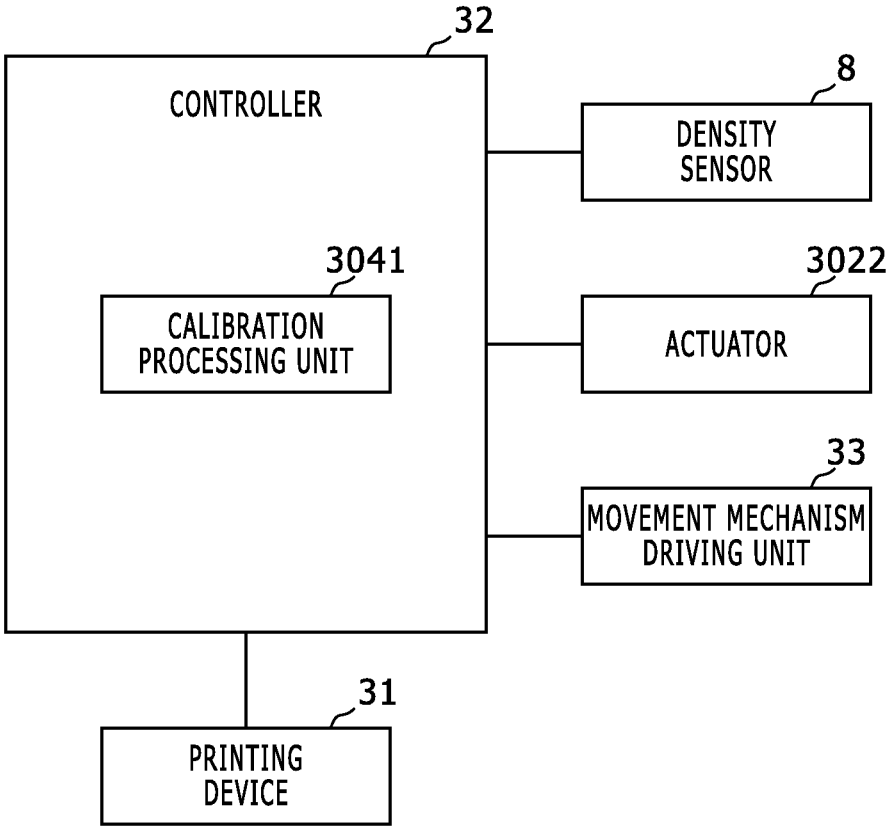
FIG. 12 shows a block diagram that indicates a part of an electronic configuration of the image forming apparatus in Embodiment 4.

FIG. 12 shows a block diagram that indicates a part of an electronic configuration of the image forming apparatus in Embodiment 4.

In Embodiment 4, the image forming apparatus includes a printing device 31 that has a mechanical configuration shown in FIGS. 1 and 11, a controller 32, and a movement mechanism driving unit 33 such as a motor that drives the aforementioned movement mechanism (i.e. a mechanism that contacts and separates the cleaning roller 21 to and from the intermediate transfer belt 4) of the cleaning roller 21.

The controller 32 controls an unshown driving source that drives the aforementioned rollers and the like, a bias circuit that induces a primary transfer bias, the development devices 3*a* to 3*d*, the exposure devices 2*a* to 2*d* and the like, and thereby performs developing, transferring and fixing the toner image, feeding a paper sheet, printing on the paper sheet, and outputting the paper sheet. The primary transfer biases are applied between the photoconductor drums 1*a* to 1*d* and the intermediate transfer belt 4, respectively. The controller 32 includes a computer that acts in accordance with a control program, an ASIC and/or the like, and acts as sorts of processing units. In Embodiment 4, the controller 32 acts as a calibration processing unit 3041. The calibration processing unit 3041 performs a calibration process (adjustment of a highest toner density and/or an intermediate toner gradation level) periodically or at a predetermined timing.

The calibration processing unit 3041 changes a position in a primary scanning direction at which the calibration toner image is carried, and moves the density sensor 8 and the cleaning device 11 in the primary scanning direction in accordance with the change of the position of the calibration toner image. Thus, a portion that the contact member 11*a* of the cleaning device 11 contacts to the intermediate transfer belt 4 is dispersed in the primary scanning direction, and consequently, ununiform change of a surface condition of the intermediate transfer belt 4 in the primary scanning direction is restrained.

Specifically, the calibration processing unit 3041 changes an exposure position of the exposure device 2*a*, 2*d*, 2*c* or 2*d* and thereby changes a position of an electrostatic latent image of the calibration toner image, and thereby changes a position of the calibration toner image that is developed on the photoconductor drum 1*a*, 1*b*, 1*c* or 1*d* by the development device 3*a*, 3*b*, 3*c* or 3*d* and primarily transferred to the intermediate transfer belt 4. In accordance with the position change of the calibration toner image, the calibration processing unit 3041 moves the cleaning device 11 and the density sensor 8 linearly along the primary scanning direction, for example, within a predetermined movable range as shown in FIG. 11, using the actuator 3022.

The calibration processing unit 3041 changes in the primary scanning direction a position where the calibration toner image is carried from a position where the calibration toner image is carried in a previous calibration process, and also moves the density sensor 8 and the cleaning device 11 in the primary scanning direction in accordance with a position of the calibration toner image.

Further, the calibration processing unit 3041 may set a carrying position of the calibration toner image on the intermediate transfer belt 4 on the basis of arrangement of a printing toner image so as to arrange in parallel to the printing toner image along the secondary scanning direction, as shown in FIG. 14. Even in such a case, the cleaning device 11 is moved in accordance with the carrying position of the calibration toner image, and therefore, the cleaning device 11 removes the calibration toner image so as not to remove the printing toner image.

Furthermore, the calibration processing unit 3041 may store a history of arrangement (i.e. primary scanning directional distribution of total numbers of toner pixels in the printing toner image) of the printing toner image on each printing page in an unshown non-volatile storage device, and if plural carryable positions are available when a carrying position of the calibration toner image is set in parallel to the printing toner image along the secondary scanning direction on the basis of the arrangement of the printing toner image, for example, then the calibration processing unit 3041 may set a carrying position of the calibration toner image as a primary scanning directional position that the printing toner image was arranged with the highest frequency in the history among the plural carryable positions of the calibration toner image in the primary scanning direction.

Consequently, a position where the printing toner image was carried with a large opportunity and the calibration toner image was carried with a small opportunity is preferentially selected when this position is available, and the calibration toner image is carried so as to be more uniformly dispersed in the primary scanning direction.

Other parts of the configuration and behaviors of the image forming apparatus in Embodiment 4 are identical or similar to those in Embodiment 1, and therefore not explained here.

The following part explains a behavior of the image forming apparatus in Embodiment 4.

When coming an execution timing of the calibration process, the calibration processing unit 3041 (a) determines a carrying position of the calibration toner image for a current calibration process as mentioned, (b) controls the actuator 3022 and thereby moves the density sensor 8 and the cleaning device 11 in accordance with the determined carrying position, (c) performs development of a calibration toner image using the exposure devices 2*a* to 2*d* and the development devices 3*a* to 3*d*, (d) performs primary transfer of the calibration toner image to the determined position on the intermediate transfer belt 4 as shown in FIG. 13, 14 or 15 for example, and (e) detects the calibration toner image using the density sensor 8, determines a density of the calibration toner image on the basis of an output signal of the density sensor 8, and adjusts a toner density characteristic and a toner gradation characteristic on the basis of the determined density.

In this process, the calibration processing unit 3041 controls the movement mechanism driving unit 33 and thereby contacts the cleaning device 11 to the intermediate transfer belt 4 and causes the cleaning device 11 to remove the calibration toner image. Here, the contact member 11*a* of the cleaning device 11 contacts to the contact range of the intermediate transfer belt 4.

As mentioned, in Embodiment 4, the cleaning device 11 contacts to a part of the intermediate transfer belt 4 in a primary scanning direction in the calibration process and removes from the intermediate transfer belt 4 the calibration toner image that passed at a detection position of the density sensor 8. The calibration processing unit 3041 changes a position in a primary scanning direction at which the calibration toner image is carried, and moves the density sensor 8 and the cleaning device 11 in the primary scanning direction in accordance with the change of the position of the calibration toner image.

Consequently, a portion that the contact member 11*a* of the cleaning device 11 contacts to the intermediate transfer belt 4 is dispersed in the primary scanning direction, and ununiform change of a surface condition of the intermediate transfer belt 4 in the primary scanning direction is restrained. In addition, even though a partial contact occurs between the intermediate transfer belt 4 and the cleaning device 11 that removes the calibration toner image, a low quality image due to the partial contact on a printed matter is restrained.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

For example, in Embodiment 1 or 2, the density correction unit 42 or 1042 may gradually change the strength of the density correction at the end of the aforementioned additional correction range. In such a case, even if image density change occurs at the end due to the change of the density correction strength, such image density change is not visually easily perceived.

Further, in Embodiment 1 or 2, the density correction unit 42 or 1042 may change along the secondary scanning direction a primary scanning directional position of the end of the additional correction range. In such a case, even if image density change occurs at the end due to the change of the density correction strength, such image density change is not visually easily perceived because an occurrence position of the image density change in the primary scanning direction changes along the secondary scanning direction.

Furthermore, in Embodiment 4, if plural carryable positions are available when a carrying position of the calibration toner image is set in parallel to the printing toner image along the secondary scanning direction on the basis of the arrangement of the printing toner image, for example, then the calibration processing unit 3041 may set a carrying position of the calibration toner image as a position within a predetermined distance from a current position of the density sensor 8 and the cleaning device 11 among the plural carryable positions of the calibration toner image in the primary scanning direction. In such a case, for example, the "predetermined distance" is set as a distance obtained by dividing a predetermined time by a movement speed of the density sensor 8 and the cleaning device 11, and the "predetermined time" is set as a time from the current time point to a primary transfer timing of the calibration toner image.

What is claimed is:

1. An image forming apparatus, comprising:

an intermediate transfer belt configured to carry a calibration toner image;

a density sensor configured to detect a density of the calibration toner image that passes at a predetermined position;

a cleaning device configured to contact to a part of the intermediate transfer belt in a primary scanning direction and remove from the intermediate transfer belt the calibration toner image that passed at the predetermined position; and a density correction unit configured to perform density correction of a printing toner image in the primary scanning direction;

wherein the density correction unit changes a strength of the density for a contact range to which the cleaning device contacts on the intermediate transfer belt, the strength changed in accordance with the number of times of a calibration process; wherein the density correction unit gradually changes the strength of the density in an end of the contact range; wherein the density correction unit changes a primary scanning directional position of the end of the contact range along a secondary scanning direction.

2. The image forming apparatus according to claim 1, wherein the density correction unit performs the density correction with respective intensities corresponding to a predetermined number of correction blocks into which a printing image area in the primary scanning direction is divided; and the end of the contact range agrees with a boundary between the correction blocks.

3. An image forming apparatus, comprising:

an intermediate transfer belt configured to carry a calibration toner image;

a first optical sensor configured to (a) irradiate with light a predetermined first position at which the calibration toner image passes and (b) receive reflection light from the first position;

a calibration processing unit configured to perform a calibration process based on an output signal of the first optical sensor, the output signal corresponding to the calibration toner image;

a cleaning device configured to (a) contact to a part of the intermediate transfer belt in a primary scanning direction and (b) remove from the intermediate transfer belt the calibration toner image that passed at the first position;

a second optical sensor configured to (a) irradiate with light a predetermined second position and (b) receive reflection light from the second position, the second position being a position other than a contact range to which the cleaning device contacts on the intermediate transfer belt; and a density correction unit configured to perform density correction of a printing toner image in the primary scanning direction;

wherein the density correction unit changes a strength of the density in the contact range on the basis of (a) an output signal of the first optical sensor and (b) an output signal of the second optical sensor, the output signal of the first optical sensor corresponding to a surface material of the intermediate transfer belt at the first position, and the output signal of the second optical sensor corresponding to a surface material of the intermediate transfer belt at the second position; and wherein the density correction unit gradually changes the strength of the density in an end of the contact range.

4. The image forming apparatus according to claim 3, wherein the density correction unit performs the density correction with respective intensities corresponding to a predetermined number of correction blocks into which a printing image area in the primary scanning direction is divided; and an end of the contact range agrees with a boundary between the correction blocks.

5. The image forming apparatus according to claim 3, wherein the density correction unit changes along a secondary scanning direction a position of an end of the contact range.

6. An image forming apparatus, comprising:

an intermediate transfer belt configured to carry a calibration toner image;

a density sensor configured to detect a density of the calibration toner image that passes at a predetermined position;

a first cleaning device configured to (a) contact to a predetermined contact range of the intermediate transfer belt in a primary scanning direction in a calibration process and (b) remove from the intermediate transfer belt the calibration toner image that passed at the predetermined position; and a second cleaning device configured to contact to a residual range other than the predetermined contact range of the intermediate transfer belt in a primary scanning direction in the calibration process.

7. The image forming apparatus according to claim 6, wherein the first cleaning device is separated from the intermediate transfer belt when the intermediate transfer belt carries a printing toner image in the predetermined range; and the second cleaning device is separated from the intermediate transfer belt together with the first cleaning device.

8. The image forming apparatus according to claim 6, wherein the second cleaning device contacts to the residual range of the primary scanning direction in a range of a secondary scanning direction to which the first cleaning device contacts on the intermediate transfer belt.

9. The image forming apparatus according to claim 6, wherein the intermediate transfer belt carries a printing toner image and a calibration toner image in parallel along a secondary scanning direction; and the first cleaning device does not remove the printing toner image but removes the calibration toner image.

10. The image forming apparatus according to claim 6, further comprising a secondary transfer roller;

wherein the intermediate transfer belt carries a printing toner image;

the secondary transfer roller secondarily transfers the a printing toner image;

the first cleaning device is arranged in an upstream side of the secondary transfer roller in a movement direction of the intermediate transfer belt; and the second cleaning device is arranged in a downstream side of the secondary transfer roller in the movement direction of the intermediate transfer belt.

11. An image forming apparatus, comprising:

an intermediate transfer belt configured to carry a calibration toner image;

a density sensor configured to detect a density of the calibration toner image that passes at a predetermined position;

a cleaning device configured to (a) contact to a part of the intermediate transfer belt in a primary scanning direction in a calibration process and (b) remove from the intermediate transfer belt the calibration toner image that passed at the predetermined position; and a calibration processing unit configured to (a) change a position in a primary scanning direction at which the calibration toner image is carried, and (b) move the density sensor and the cleaning device in the primary scanning direction in accordance with the change of the position of the calibration toner image; the density sensor and the cleaning device being movable by an actuator controlled by the calibration processing unit.

12. The image forming apparatus according to claim 11, wherein the calibration processing unit changes in the primary scanning direction a position at which the calibration toner image is carried from a position at which the calibration toner image was carried in a previous calibration process, and moves the density sensor and the cleaning device in the primary scanning direction in accordance with the change of the position of the calibration toner image.

13. The image forming apparatus according to claim 11, wherein the calibration processing unit sets a carrying position of the calibration toner image on the intermediate transfer belt on the basis of arrangement of a printing toner image so as to arrange the calibration toner image in parallel to the printing toner image along a secondary scanning direction; and the cleaning device does not remove the printing toner image but removes the calibration toner image.

14. The image forming apparatus according to claim 11, wherein if there are plural possible positions in the primary scanning direction to carry the calibration toner image, the calibration processing unit determines as a position at which the calibration toner image is carried a position that has a highest arrangement frequency of the printing toner image among the possible positions in a history of arrangement of a printing toner image.

15. The image forming apparatus according to claim 11, wherein if there are plural possible positions in the primary scanning direction to carry the calibration toner image, the calibration processing unit determines as a position at which the calibration toner image is carried a position within a predetermined distance from a current arrangement position of the density sensor and the cleaning device among the possible positions.

* * * * *